US009085158B2

(12) United States Patent
Kobayashi et al.

(10) Patent No.: US 9,085,158 B2
(45) Date of Patent: Jul. 21, 2015

(54) LIQUID DISCHARGING APPARATUS AND METHOD FOR CLEANING DISCHARGE HEAD

(71) Applicant: SEIKO EPSON CORPORATION, Tokyo (JP)

(72) Inventors: Yoshihiro Kobayashi, Matsumoto (JP); Toshio Kumagai, Shiojiri (JP); Katsuyoshi Onodera, Chino (JP); Kazutoshi Shimizu, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/195,690

(22) Filed: Mar. 3, 2014

(65) Prior Publication Data

US 2014/0253634 A1 Sep. 11, 2014

(30) Foreign Application Priority Data

Mar. 5, 2013 (JP) ..... 2013-042671

(51) Int. Cl.

| | |
|---|---|
| ***B41J 2/015*** | (2006.01) |
| ***B41J 2/165*** | (2006.01) |
| ***B41J 11/00*** | (2006.01) |
| *B41J 25/00* | (2006.01) |

(52) U.S. Cl.

CPC ..... *B41J 2/16535* (2013.01); *B41J 2/16538* (2013.01); *B41J 2/16552* (2013.01); *B41J 11/002* (2013.01); *B41J 2002/1655* (2013.01); *B41J 2025/008* (2013.01)

(58) Field of Classification Search

USPC ..... 347/20–21, 28, 33

See application file for complete search history.

(56) References Cited

U.S. PATENT DOCUMENTS

| | | | | |
|---|---|---|---|---|
| 8,123,329 | B2 * | 2/2012 | Yahiro | 347/21 |
| 2004/0223028 | A1 * | 11/2004 | Yokoyama et al. | 347/23 |

FOREIGN PATENT DOCUMENTS

| | | |
|---|---|---|
| JP | 10-151759 | 6/1998 |
| JP | 2003-182088 | 7/2003 |
| JP | 2005-103895 | 4/2005 |
| JP | 2009-233896 | 10/2009 |
| JP | 2011-189647 | 9/2011 |

* cited by examiner

*Primary Examiner* — Jason Uhlenhake

(74) *Attorney, Agent, or Firm* — Workman Nydegger

(57) ABSTRACT

There is provided a liquid discharging apparatus which includes: a discharge head that includes a nozzle forming surface on which nozzles for discharging liquid are formed; a wiping member that performs wiping by relatively moving on the nozzle forming surface in a state in which a wiping surface abuts on the nozzle forming surface; a cleaning liquid supply unit that supplies cleaning liquid to a liquid supplied surface which is a different surface from the nozzle forming surface and with which the wiping surface can come into contact; and a control unit that causes the wiping surface to abut on the liquid supplied surface to which the cleaning liquid is supplied, and then causes the wiping surface to relatively move on the nozzle forming surface in a state in which the wiping surface abuts on the nozzle forming surface.

12 Claims, 9 Drawing Sheets

LIQUID DISCHARGING APPARATUS AND METHOD FOR CLEANING DISCHARGE HEAD

BACKGROUND

1. Technical Field

The present invention relates to a technology that cleans the nozzle forming surface of a discharge head which discharges liquid, and, in particular, to a technology that performs wiping with a wiping member on the nozzle forming surface using cleaning liquid.

2. Related Art

In the related art, a liquid discharging apparatus, such as an ink jet printer, which discharges liquid, such as ink or the like, from the nozzles of a discharge head is known. In such an apparatus, there is a case in which the liquid discharged from the nozzles adheres to the nozzle forming surface of the discharge head. If the liquid adheres to the nozzle forming surface, there is a problem in that the liquid is not appropriately discharged from the nozzles, thereby causing deterioration of image quality. Here, various technologies for removing liquid which adheres to the nozzle forming surface of a discharge head are proposed.

For example, a head cleaning mechanism disclosed in JP-A-2009-233896 is provided with an ejecting unit that ejects cleaning liquid onto a nozzle forming surface (droplet discharge surface) in order to suitably remove liquid which adheres to the nozzle forming surface. Further, after the cleaning liquid is ejected onto the nozzle forming surface, wiping is performed by a wiping member, and thus it is possible to suitably clean the nozzle forming surface.

As described above, in the head cleaning apparatus disclosed in JP-A-2009-233896, the cleaning liquid is directly ejected onto the nozzle forming surface, and thus the cleaning liquid easily comes in nozzles. Therefore, for example, there is a problem in that meniscus which are formed in ink in the vicinity of the openings of the nozzles are destroyed by the cleaning liquid which comes in the nozzles, and thus it is difficult to appropriately discharge ink from the nozzles. Here, in JP-A-2009-233896, it is described that the cleaning liquid is ejected onto the region of the nozzle forming surface other than the nozzles, and thus the cleaning liquid is prevented from coming in the nozzles. However, if the cleaning liquid is ejected onto the nozzle forming surface, there is limitation of preventing the cleaning liquid from coming in the nozzles.

SUMMARY

An advantage of some aspects of the invention is to provide a technology that is capable of effectively preventing cleaning liquid from coming in nozzles in a case of supplying the cleaning liquid when the nozzle forming surface of a discharge head is wiped using the cleaning liquid.

According to an aspect of the invention, there is provided a liquid discharging apparatus including: a discharge head that includes a nozzle forming surface on which nozzles for discharging liquid are formed; a wiping member that performs wiping by relatively moving the nozzle forming surface in a state in which a wiping surface abuts on the nozzle forming surface; a cleaning liquid supply unit that supplies cleaning liquid to a liquid supplied surface which is a different surface from the nozzle forming surface and with which the wiping surface can come into contact; and a control unit that causes the wiping surface to abut on the liquid supplied surface to which the cleaning liquid is supplied, and then causes the wiping surface to relatively move on the nozzle forming surface in a state in which the wiping surface abuts on the nozzle forming surface.

In addition, according to another aspect of the invention, there is provided a method of cleaning a discharge head that includes a nozzle forming surface on which nozzles for discharging liquids are formed, including: supplying cleaning liquid to a liquid supplied surface which is a different surface from the nozzle forming surface and which can abut on a wiping surface of a wiping member; and performing wiping by causing the wiping surface to abut on the liquid supplied surface to which the cleaning liquid is supplied, and then causing the wiping surface to relatively move on the nozzle forming surface in a state in which the wiping surface abuts on the nozzle forming surface.

In the liquid discharging apparatus and the method of cleaning the discharge head, the wiping is performed in such a way that the wiping surface of the wiping member relatively moves on the nozzle forming surface in a state in which the wiping surface of the wiping member abuts on the nozzle forming surface. At this time, according to the aspect of the invention, after the cleaning liquid is supplied to the liquid supplied surface with which the wiping surface of the wiping member can come into contact and the wiping surface is caused to abut on the liquid supplied surface, the wiping is performed. When the wiping surface abuts on the liquid supplied surface, the cleaning liquid which is supplied to the liquid supplied surface moves to the wiping surface, and the wiping is performed in a state in which the wiping surface holds the cleaning liquid. Therefore, it is possible to effectively clean the nozzle forming surface. Besides, according to the aspect of the invention, the cleaning liquid is not directly supplied to the nozzle forming surface but is supplied to the liquid supplied surface which is different from the nozzle forming surface. Therefore, when the cleaning liquid is supplied, it is possible to effectively prevent the cleaning liquid from coming in the nozzles.

In the liquid discharging apparatus, the liquid supplied surface may have a height in a vertical direction, and the control unit may cause the wiping surface to abut on a lower end portion of the liquid supplied surface to which the cleaning liquid is supplied, and then may cause the wiping surface to relatively move on the nozzle forming surface in the state in which the wiping surface abuts on the nozzle forming surface. If the cleaning liquid is supplied to the liquid supplied surface which has the height in the vertical direction, the cleaning liquid flows to a lower side along the liquid supplied surface, and thus the cleaning liquid easily accumulates in the lower end portion of the liquid supplied surface. When the wiping surface is caused to abut on the lower end portion of the liquid supplied surface, it is possible to hold a large amount of the cleaning liquid on the wiping surface, and thus it is possible to effectively use the cleaning liquid.

Further, when the lower end portion of the liquid supplied surface is connected to a connected surface which is different from the liquid supplied surface, a corner portion may be formed between the liquid supplied surface and the connected surface, and the corner portion may face the lower side in the vertical direction. As above, when the lower end portion of the liquid supplied surface is connected to the connected surface and the corner portion is formed between the liquid supplied surface and the connected surface, the cleaning liquid which is supplied to the liquid supplied surface flows to the lower side along the liquid supplied surface and reaches the corner portion which includes the lower end portion of the liquid supplied surface. Further, because the corner portion faces the lower side, the cleaning liquid which reaches the corner portion does not have an escape, and thus the cleaning liquid is more securely accumulated in the corner portion. As a result, it is possible to utilize a larger amount of the cleaning liquid to clean the nozzle forming surface.

Further, the liquid supplied surface may be a side surface of the discharge head, and the connected surface may be the nozzle forming surface. When a function as the liquid supplied surface is provided to the side surface of the discharge head and the connected surface is set to the nozzle forming surface, it is not necessary to provide an additional member which includes the liquid supplied surface and the connected surface, and thus it is possible to reduce the number of components.

In addition, when the cleaning liquid is supplied, the wiping surface of the wiping member may face the liquid supplied surface, and the cleaning liquid supply unit may eject the cleaning liquid such that the cleaning liquid lands on a facing region of the liquid supplied surface, which the wiping surface faces. There is a case in which the cleaning liquid which is ejected toward the liquid supplied surface removes and dusts off an extraneous substance which adheres to the liquid supplied surface when the cleaning liquid lands. However, when the cleaning liquid lands on a facing range of the liquid supplied surface, which the tip portion of the wiping member faces, most of the dusted-off extraneous substance does not adhere to the tip portion of the wiping surface of the wiper. Therefore, the dusted-off extraneous substance adheres to the tip portion of the wiping surface of the wiper, and thus it is possible to prevent the nozzle forming surface from being damaged.

In addition, the cleaning liquid supply unit may eject the cleaning liquid such that a landing angle which is formed of a landing direction, acquired when the cleaning liquid lands on the liquid supplied surface, and the liquid supplied surface is equal to or less than 45 degrees. When the landing angle is set to be equal to or less than 45 degrees as above, it is possible to prevent the cleaning liquid from rebounding from the liquid supplied surface when the cleaning liquid lands. Therefore, it is possible to effectively use the cleaning liquid which is supplied to the liquid supplied surface for the wiping. In addition, although there is a case in which the cleaning liquid which is ejected toward the liquid supplied surface removes and dusts off the extraneous substance which adheres to the liquid supplied surface when the cleaning liquid lands, it is possible to prevent the dusted-off extraneous substance from adhering to the wiping surface of the wiping member by setting a landing angle to be equal to or less than 45 degrees. Therefore, it is possible to suitably prevent the dusted-off extraneous substance from damaging the nozzle forming surface.

In addition, the control unit may perform a cleaning mode in which the wiping member is cleaned in such a way that the cleaning liquid supply unit supplies the cleaning liquid to the wiping member. If liquid which is discharged from the discharge head adheres to the wiping member, there is a problem in that liquid which adheres to the wiping member stains the nozzle forming surface when the wiping is performed. Here, as in the above configuration, when a cleaning mode in which the wiping member is cleaned using the cleaning liquid is provided, it is possible to appropriately clean the wiping member and suitably perform the wiping.

In this case, in the cleaning mode, the control unit may move the liquid supplied surface to a location which the cleaning liquid from the cleaning liquid supply unit does not reach, and may move the wiping member to a location which the cleaning liquid from the cleaning liquid supply unit reaches. In this way, it is possible to mutually switch from a state in which the cleaning liquid can be supplied to the liquid supplied surface to a state in which the cleaning liquid can be supplied to the wiping member without moving the cleaning liquid supply unit, and thus it is possible to simply configure the cleaning liquid supply unit.

In addition, the liquid may be photocurable ink that is cured when light is irradiated, the liquid discharging apparatus may further include a light irradiation device that irradiates light, and a light shielding unit that can shield against light irradiated from the light irradiation device, and, when the light irradiation device is operated, the control unit may maintain the wiping member in a location in which light from the light irradiation device can be shielded by the light shielding unit. When photocurable ink is used as the liquid, the ink which adheres to the wiping member is cured by light, and thus it is difficult to remove the ink. Here, when the light irradiation device is operated, the wiping member is maintained in a location in which light from the light irradiation device can be shielded by the light shielding unit, and thus it is possible to prevent the ink which adheres to the wiping member from being cured, and it is possible to maintain the wiping member in a good state.

In addition, the liquid discharging apparatus may further include: a capping member that can seal the nozzles; and a support member that supports the wiping member and the capping member to be integrally moved. When the capping member is provided, it is possible to cap the nozzles of the discharge head. Further, when the support member which supports the wiping member and the capping member to be integrally moved is provided, it is possible to move the capping member together with the wiping member. Therefore, for example, when the wiping member is moved to a location in which the wiping member can be cleaned in a cleaning mode or when the wiping member is moved to a location in which the wiping member can be shielded against light by the light shielding unit, it is possible to clean the capping member or arrange the capping member in the location in which light can be shielded together with the wiping member by moving the capping member at the same time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
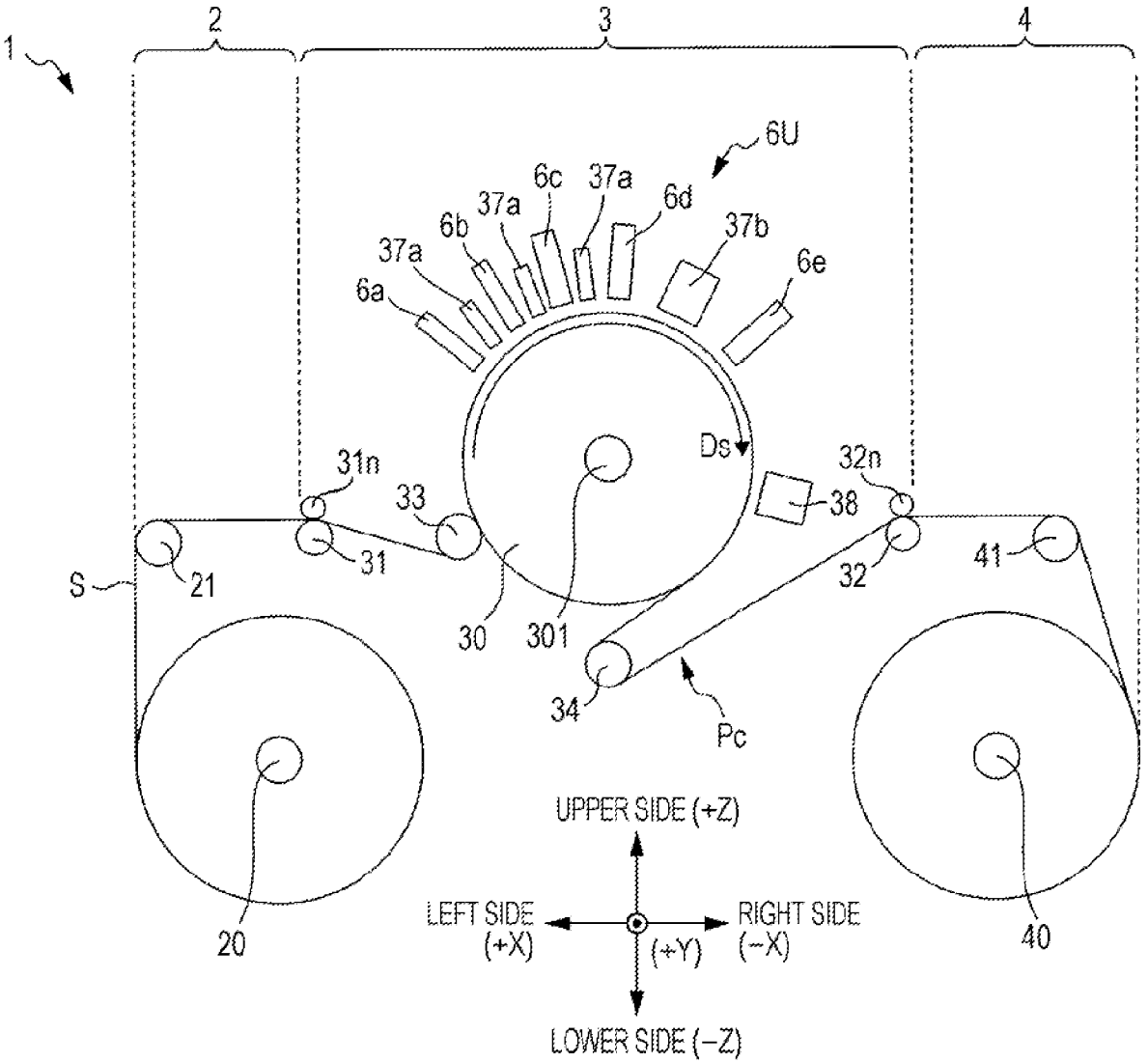
FIG. 1 is a front view schematically illustrating the configuration of a printer to which the invention can be applied.

Hereinafter, the configuration of a printer to which the invention can be applied will be described with reference to the accompanying drawings. FIG. 1 is a front view illustrating the configuration of a printer to which the invention can be applied. Meanwhile, in the drawings below, a 3-dimensional coordinate system which corresponds to the horizontal direction X, the front-back direction Y, and the vertical direction Z of a printer 1 is used if necessary for clarity of an arrangement relationship between the respective units of the printer 1.

As shown in FIG. 1, in the printer 1, a feeding section 2, a processing section 3 and a winding section 4 are arranged in the horizontal direction. The feeding section 2 and the winding section 4 include a feeding shaft 20 and a winding shaft 40, respectively. Further, both ends of a sheet S (web) are wound around the feeding section 2 and the winding section 4 in a roll shape, and are stretched therebetween. After the sheet S is transported from the feeding shaft 20 to the processing section 3 along a transport path Pc which is stretched as described above and receives an image recording process performed by a print unit 6U, the sheet S is transported to the winding shaft 40. The kind of the sheet S is generally classified into a paper system and a film system. To give a specific example, the paper system includes wood-free paper, cast coated paper, art paper, coated paper and the like, and the film system includes synthetic paper, polyethylene terephthalate (PET), polypropylene (PP), and the like. Meanwhile, in the description below, one surface, on which an image is recorded, of both surfaces of the sheet S is called a front surface, and an opposite side surface thereof is called a back surface.

The feeding section 2 includes the feeding shaft 20 which winds the end of the sheet S, and a driven roller 21 which winds the sheet S that is drawn from the feeding shaft 20. The feeding shaft 20 winds and supports the end of the sheet S in a state in which the front surface of the sheet S faces the outside. Further, when the feeding shaft 20 rotates in the clockwise direction of FIG. 1, the sheet S which is wound by the feeding shaft 20 is fed to the processing section 3 through the driven roller 21.

In the processing section 3, an image is recorded on the sheet S using the print unit 6U while the sheet S which is fed from the feeding section 2 is supported by a platen drum 30. That is, the print unit 6U includes a plurality of print heads 6*a* to 6*e* which are aligned along the front surface of the platen drum 30. Further, when the print heads 6*a* to 6*e* discharge ink onto the sheet S which is supported by the front surface of the platen drum 30, an image is recorded on the sheet S. In the processing section 3, a front driving roller 31 and a rear driving roller 32 are provided on both sides of the platen drum 30, the sheet S which is transported from the front driving roller 31 to the rear driving roller 32 is supported by the platen drum 30, and the reception of image print is performed thereon.

The front driving roller 31 includes a plurality of minute protrusions which are formed through thermal spraying on an outer peripheral surface, and winds the sheet S, which is fed from the feeding section 2, from the back surface side. Further, when the front driving roller 31 rotates in the clockwise direction of FIG. 1, the sheet S which is fed from the feeding section 2 is transported to the platen drum 30 through a driven roller 33. Meanwhile, a nip roller 31*n* is provided for the front driving roller 31. The nip roller 31*n* abuts on the front surface of the sheet S while being energized to a side of the front driving roller 31, and interposes the sheet S with the front driving roller 31. Therefore, the friction force is secured between the front driving roller 31 and the sheet S, and thus it is possible to securely transport the sheet S by the front driving roller 31.

The platen drum 30 is a cylindrical-shaped drum which is rotatably supported by a support mechanism which is not shown in the drawing, and winds the sheet S which is transported from the front driving roller 31 to the rear driving roller 32 from the back surface side. The platen drum 30 supports the sheet S form the back surface side while performing driven rotation in the transport direction Ds of the sheet S by receiving the friction force between the platen drum 30 and the sheet S. In addition, in the processing section 3, the driven rollers 33 and 34 which fold back the sheet S are provided on both sides of the winding section to the platen drum 30. The driven roller 33 of the rollers winds the front surface of the sheet S between the front driving roller 31 and the platen drum 30, and folds back the sheet S. In contrast, the driven roller 34 winds the front surface of the sheet S between the platen drum 30 and the rear driving roller 32, and folds back the sheet S. As described above, when the sheet S is folded back on each of the upstream and downstream sides of the transport direction Ds for the platen drum 30, it is possible to secure a long winding section of the sheet S for the platen drum 30.

The rear driving roller 32 includes a plurality of minute protrusions which are formed through thermal spraying on an outer peripheral surface, and winds the sheet S which is transported from the platen drum 30 through the driven roller 34 from the back surface side. Further, when the rear driving roller 32 rotates in the clockwise direction of FIG. 1, the sheet S is transported to the winding section 4. Meanwhile, a nip roller 32*n* is provided for the rear driving roller 32. The nip roller 32*n* abuts on the front surface of the sheet S while being energized to a side of the rear driving roller 32, and interposes the sheet S with the rear driving roller 32. Therefore, the friction force is secured between the rear driving roller 32 and the sheet S, and thus it is possible to securely transport the sheet S by the rear driving roller 32.

As described above, the sheet S which is transported from the front driving roller 31 to the rear driving roller 32 is supported by the outer peripheral surface of the platen drum 30. Further, in the processing section 3, the plurality of print heads 6*a* to 6*d* corresponding to colors which are different from each other are provided in order to record a color image on the front surface of the sheet S which is supported by the platen drum 30. More specifically, four print heads 6*a* to 6*d* corresponding to yellow, cyan, magenta, and black are aligned in the order of the colors along the transport direction Ds.

The print heads 6*a* to 6*d* include the same configuration as each other, and face the front surface of the sheet S which is supported by the platen drum 30 with some clearance. Further, the print heads 6*a* to 6*d* discharge ink corresponding to colors from nozzles which open toward the front surface of the platen drum 30 using an ink jet method. Therefore, ink is discharged onto the sheet S which is transported along the transport direction Ds, and the color image is formed on the front surface of the sheet S.

Here, ultraviolet (UV) ink (photocurable ink), which is cured when ultraviolet (light) is irradiated, is used as ink (recording fluid). Here, in order to cure the ink and fix the ink to the sheet S, UV lamps 37*a* and 37*b* are provided. Meanwhile, the ink curing is performed by dividing into two stages, that is, temporary curing and main curing. The UV lamps 37*a* for the temporary curing are arranged between the respective print heads 6*a* to 6*d*. That is, the UV lamps 37*a* perform curing (perform the temporary curing) on ink to the extent that the shape of the ink does not collapse by irradiating weak ultraviolet, and do not perform complete curing on ink. In contrast, the UV lamp 37*b* for the main curing is provided on the downstream side of the transport direction Ds with regard to the print heads 6*a* to 6*d*. That is, the UV lamp 37*b* performs complete curing (performs the main curing) on ink by irradiating stronger ultraviolet than the UV lamp 37*a*. When the temporary curing and the main curing are performed as described above, it is possible to fix the color image which is formed by the print heads 6*a* to 6*d* to the front surface of the sheet S.

Further, the print head 6*e* is arranged to face the front surface of the platen drum 30 on the downstream side of the UV lamp 37*b* in the transport direction Ds. The print head 6*e* includes the same configuration as that of each of the print heads 6*a* to 6*d*, and discharges transparent UV ink to the front surface of the sheet S using the ink jet method. That is, the print head 6*e* faces the front surface of the sheet S which is supported by the platen drum 30 with some clearance, and discharges transparent ink using the ink jet method. Accordingly, transparent ink is further discharged to the color image which is formed by the print heads 6*a* to 6*d* corresponding to four colors.

In addition, a UV lamp 38 is provided on the downstream side of the print head 6*e* in the transport direction Ds. The UV lamp 38 performs complete curing (main curing) on transparent ink which is discharged by the print head 6*e* by irradiating strong ultraviolet. Accordingly, it is possible to fix transparent ink to the front surface of the sheet S.

As described above, in the processing section 3, the color image which is coated with transparent ink is formed by appropriately discharging and curing ink on the sheet S which is supported by the platen drum 30. Further, the sheet S on which the color image is formed is transported to the winding section 4 by the rear driving roller 32.

The winding section 4 includes a winding shaft 40 which winds the end of the sheet S, and a driven roller 41 which winds the sheet S transported to the winding shaft 40. The winding shaft 40 winds and supports the end of the sheet S in a state in which the front surface of the sheet S faces the outside. Further, when the winding shaft 40 rotates in the clockwise direction of FIG. 1, the sheet S is wound around the winding shaft 40 through the driven roller 41.

Figure 2:
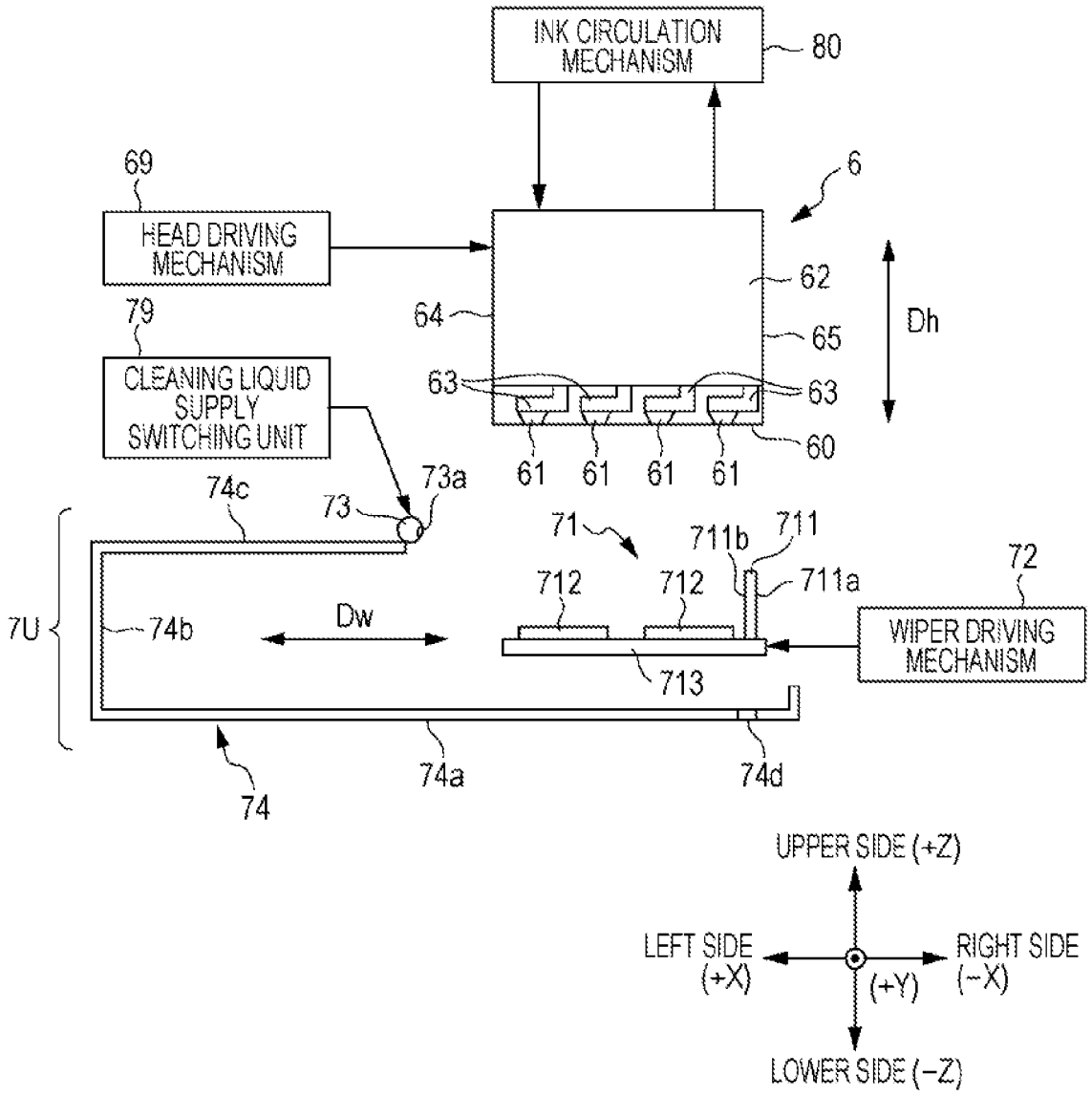
FIG. 2 is a schematic view illustrating an example of the configuration of a maintenance system.

However, a maintenance system, which performs maintenance on the print heads 6*a* to 6*e*, is provided in the printer 1. FIG. 2 is a schematic view illustrating an example of the configuration of the maintenance system. Meanwhile, since each of the print heads 6*a* to 6*e* has the same configuration, hereinafter, any one of the print heads 6*a* to 6*e* is expressed as a print head 6 without performing classification on the print heads 6*a* to 6*e*, and maintenance which is performed on the print head 6 will be described. Meanwhile, hereinafter, for convenience of explanation, a case in which a nozzle forming surface 60 is substantially horizontal as shown in FIG. 2 will be described.

A maintenance unit 7U which is provided in the maintenance system is arranged one by one for each print head 6, and performs maintenance, such as wiping, capping, and the like, on the print head 6. The maintenance unit 7U is provided to be close to the platen drum 30 in the Y direction. In contrast, the print head 6 is movable between a print location on the upper side of the platen drum 30 and a maintenance location on the upper side of the maintenance unit 7U in the Y direction by the head driving mechanism 69. Further, the print head 6 is movable in the receding direction Dh which is perpendicular to the nozzle forming surface 60 by the head driving mechanism 69 such that it is possible to acquire a cleaning location which is close to the maintenance unit 7U and a retracted location which is separated from the maintenance unit 7U in the maintenance location. Further, when maintenance is performed, the print head 6 is appropriately moved in the receding direction Dh according to a maintenance process.

The print head 6 includes nozzles 61 which open toward the nozzle forming surface 60, a reservoir 62 which temporarily stores ink, and cavities 63 which communicate the nozzles 61 with the reservoir 62. Ink is supplied to the nozzles 61 from the reservoir 62 through the cavities 63. Further, when the cavities 63 apply pressure to ink according to an operational instruction from a control unit 100 (FIG. 3), ink is discharged from the nozzles 61. In addition, an ink circulation mechanism 80 is provided for the print head 6, and the speed, pressure, and the like of ink, which is circulated between a tank that is not shown and that stores ink and the reservoir 62 of the print head 6, are adjusted by the ink circulation mechanism 80.

The maintenance unit 7U includes a moving body 71 which includes a wiper 711, caps 712 and a support member 713 for supporting the wiper 711 and the caps 712 to be integrally moved, a wiper driving mechanism 72 which moves the moving body 71 in the wiping direction Dw along the nozzle forming surface 60, a cleaning liquid supply pipe 73 which ejects cleaning liquid from ejecting holes 73*a*, and a housing 74. Each of the members has a length in the Y direction, which is equal to or greater than that of the print head 6, and it is possible to perform maintenance on the whole area of the nozzle forming surface 60. Further, when the wiper 711 moves in the wiping direction Dw in a state in which wiping surfaces 711*a* and 711*b* abut on the nozzle forming surface 60, wiping is performed. In addition, when the caps 712 adhere to the nozzle forming surface 60 such that the caps 712 cover the entire nozzles 61, the nozzles 61 are sealed, and thus capping is performed.

The cleaning liquid supply pipe 73 includes a plurality of ejecting holes 73*a* which open toward the side of the print head 6 in the Y direction. When the print head 6 is located in the cleaning location which is close to the maintenance unit 7U, the cleaning liquid can be ejected onto a liquid supplied surface 64 which is on the side of the cleaning liquid supply pipe 73 of the print head 6. Here, it is possible to appropriately use a liquid, which is suitable for cleaning work, as the cleaning liquid. However, when UV ink is used as in the embodiment, it is preferable to use a solvent which can dissolve cured UV ink. For example, ethyl diglycol acetate (EDGAC), transparent UV ink, or the like may be used as the solvent. In addition, a surfactant or a polymerization inhibitor may be added to the solvent, and the resulting solvent may be used as the cleaning liquid. Meanwhile, the supply of the cleaning liquid, which is performed through the cleaning liquid supply pipe 73, is switched by a cleaning liquid supply switching unit 79.

The housing 74 mainly includes a bottom surface portion 74*a* which is approximately parallel to the wiping direction Dw, a side wall portion 74*b* which is founded from one end of the bottom surface portion 74*a* in the wiping direction Dw, and an eave portion 74*c* which extends to the same side as the bottom surface portion 74*a* from the upper end of the side wall portion 74*b* along the wiping direction Dw. The bottom surface portion 74*a* is provided over a slightly wider range than a range in which the moving body 71 can move in the wiping direction Dw, and receives waste liquid which includes ink or cleaning liquid generated when maintenance is performed. The waste liquid which is received in the bottom surface portion 74*a* is released from the maintenance unit 7U through release holes 74*d* which are formed in the bottom surface portion 74*a*. The dimension of the eave portion 74*c* is greater than that of the moving body 71 in the wiping direction Dw. Further, when the print is operated, the moving body

71 maintains a state in which the moving body 71 is located in a stand-by location on the lower side of the eave portion 74*c* and is covered by the eave portion 74*c*. In this manner, the eave portion 74*c* shields against light (ultraviolet) which is irradiated from the UV lamps 37*a*, 37*b*, and 38, thereby preventing UV ink which adheres to the wiper 711 or the caps 712 from being cured.

Figure 3:
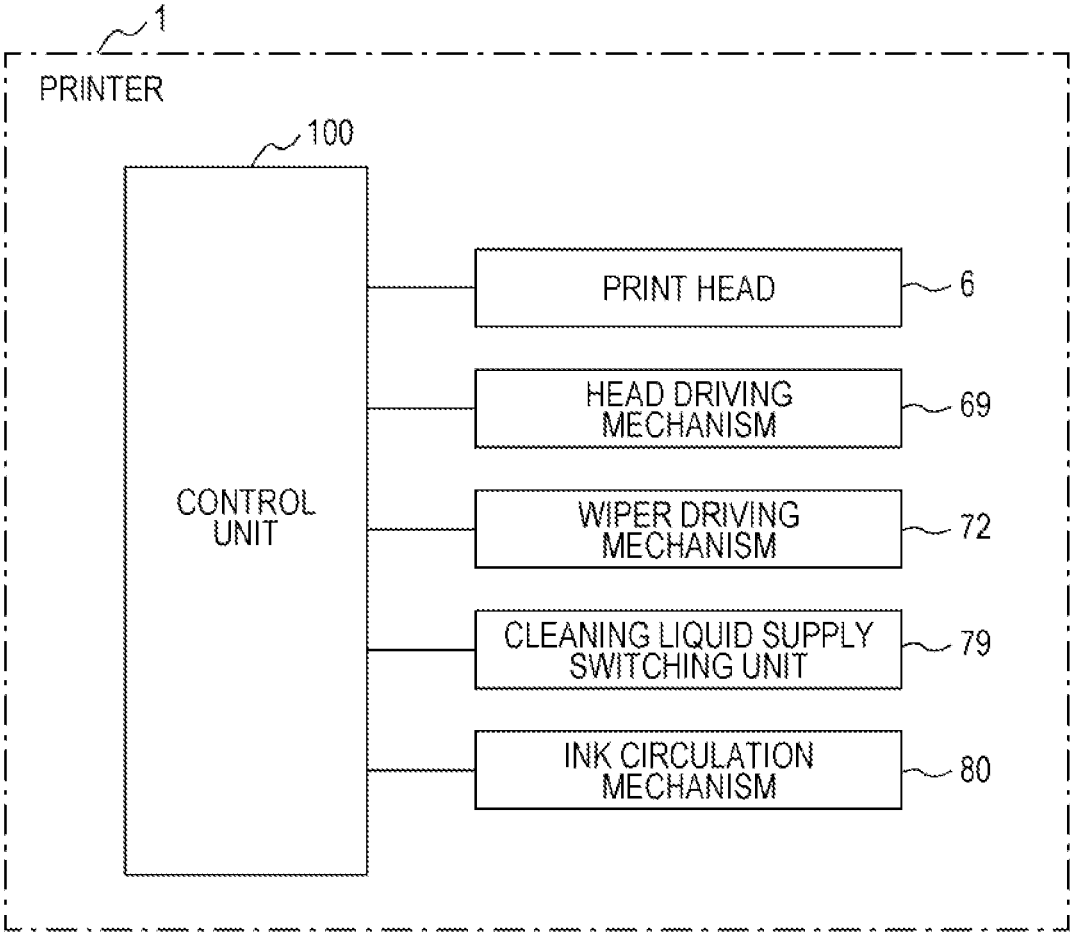
FIG. 3 is a block diagram illustrating the electrical configuration of the maintenance system.

FIG. 3 is a block diagram illustrating an example of the electrical configuration of the maintenance system. The operation of the maintenance system which is configured as described above is controlled by a control unit 100 which is provided in the printer 1. For example, when the control unit 100 controls the head driving mechanism 69, the print head 6 is appropriately arranged in each location, such as the cleaning location, the retracted location, or the like. In addition, when the control unit 100 controls the wiper driving mechanism 72, the moving body 71 is driven and the wiper 711 and the caps 712 perform an operation according to the maintenance process. In addition, when the control unit 100 controls the cleaning liquid supply switching unit 79, a state is switched into a state in which the cleaning liquid is ejected from the ejecting holes 73*a* of the cleaning liquid supply pipe 73 and a state in which the cleaning liquid is not ejected. In addition, when the control unit 100 controls the ink circulation mechanism 80, the circulation speed, the pressure or the like of ink which is supplied to the print head 6 is adjusted.

Figure 4:
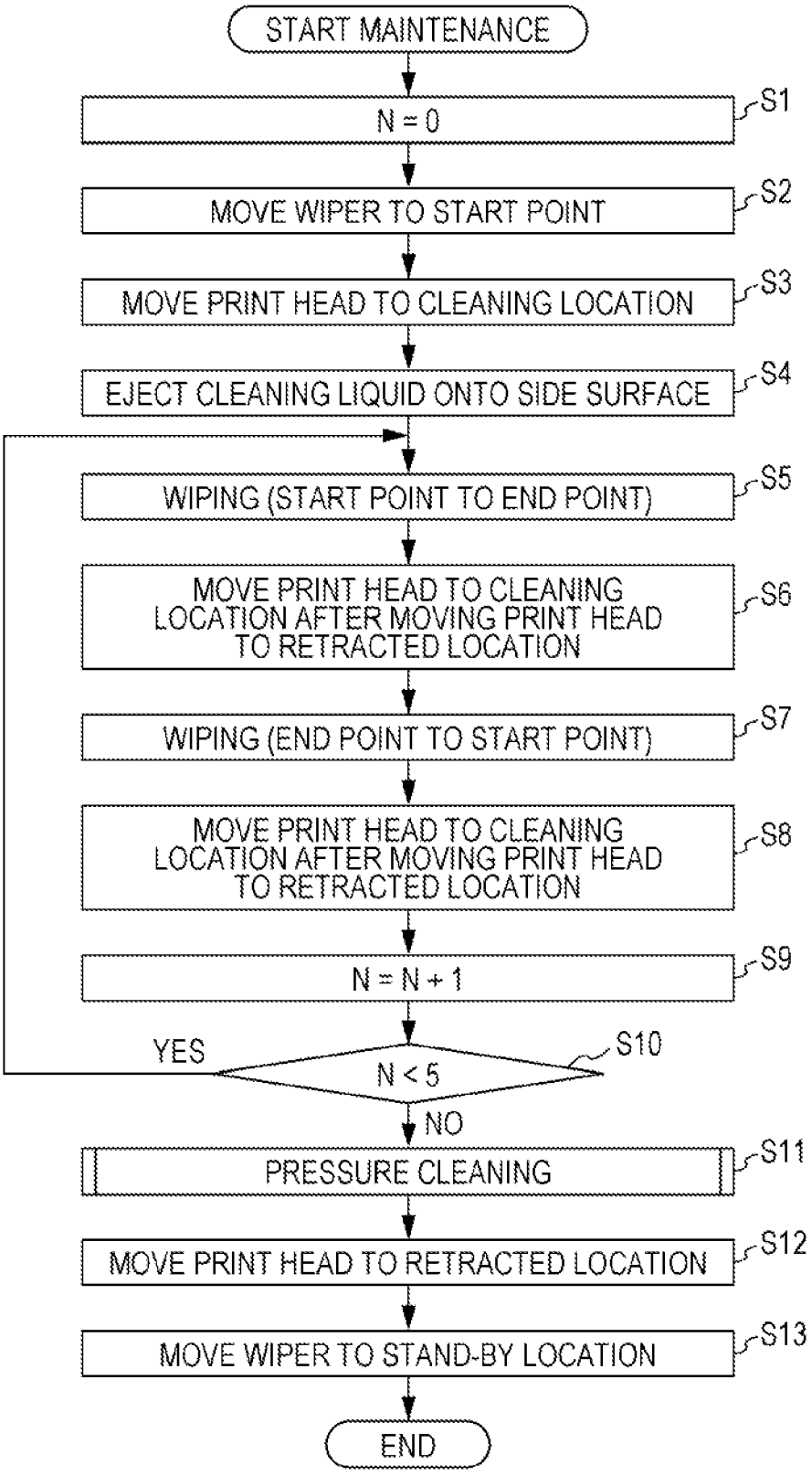
FIG. 4 is a flowchart illustrating the flow of maintenance.

Subsequently, the flow of the maintenance performed on the print head 6 using the maintenance unit 7U will be described. FIG. 4 is a flowchart illustrating the flow of the maintenance and FIGS. 5A to 5H are schematic views illustrating the states of the print head and the maintenance unit. In the maintenance which is performed by the maintenance unit 7U, the cleaning liquid is ejected onto the liquid supplied surface 64 which is the side surface of the print head 6. Thereafter, the wiper 711 is caused to perform a reciprocating operation a plurality of times in the wiping direction Dw, and pressure cleaning is further performed. Meanwhile, in the description below, the location of the end of the side of the liquid supplied surface 64 is indicated as a start point P1 in the reciprocating operation of the wiper 711, and the location of the end of the opposite side is indicated as an end point P2.

Figure 5A:
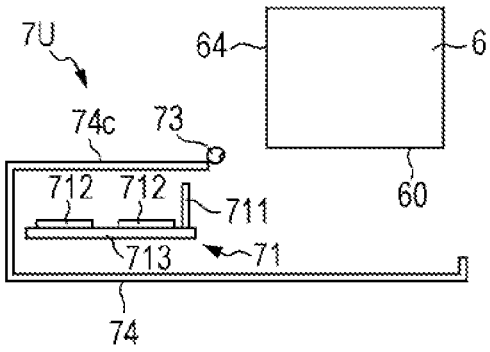
FIGS. 5A to 5H are schematic views illustrating the states of a print head and a maintenance unit.
Figure 5B:
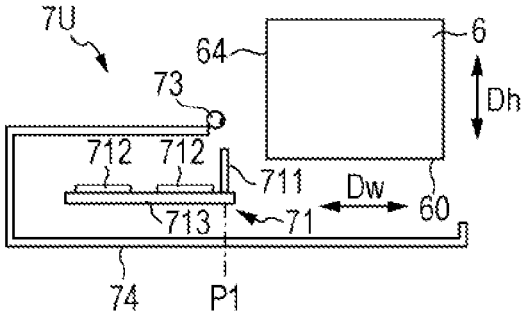

Here, as shown in FIG. 5A, it is assumed that maintenance starts in a state in which the print head 6 is located in the retracted location which is separated from the maintenance unit 7U and the wiper 711 (moving body 71) is located in the stand-by location on the lower side of the eave portion 74*c*. If maintenance starts, first, the number of times N that the wiper 711 performs a reciprocating operation is set to 0 in step S1. Further, according to the operational instruction from the control unit 100, the wiper driving mechanism 72 moves the wiper 711 to the start point P1 in step S2, and the head driving mechanism 69 moves the print head 6 to the cleaning location which is close to the maintenance unit 7U in step S3. As a result, as shown in FIG. 5B, a state in which the tip portion of the wiper 711 faces the liquid supplied surface 64 of the print head 6, in other words, a state in which the wiper 711 partially overlaps with the liquid supplied surface 64 in the receding direction Dh, is acquired.

Figure 5C:
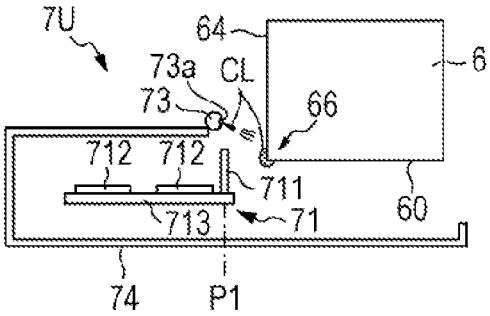

Subsequently, when the control unit 100 gives an operational instruction to supply the cleaning liquid to the cleaning liquid supply switching unit 79, the cleaning liquid is ejected from the ejecting holes 73*a* of the cleaning liquid supply pipe 73 toward the liquid supplied surface 64 of the print head 6 in step S4. The cleaning liquid which is ejected from the ejecting holes 73*a* passes through the upper side of the wiper 711, and lands on the liquid supplied surface 64 without landing on the wiper 711. As shown in FIG. 5C, if a cleaning liquid CL is ejected onto the liquid supplied surface 64, the cleaning liquid CL which adheres to the liquid supplied surface 64 flows to the lower side along the liquid supplied surface 64 and is accumulated in the corner portion 66 between the liquid supplied surface 64 and the nozzle forming surface 60.

Figure 5D:
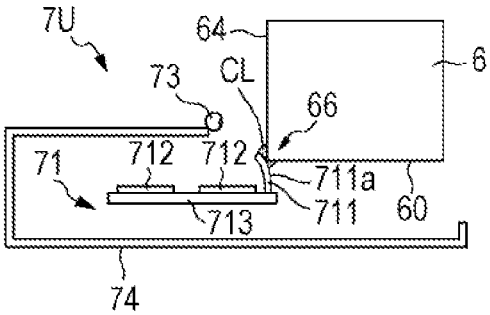

If a sufficient amount of the cleaning liquid is supplied, ejecting of the cleaning liquid stops and the wiping is performed by moving the wiper 711 from the start point P1 to the end point P2 in step S5. In this process, as shown in FIG. 5D, the wiping surface 711*a* of the wiper 711 abuts on the corner portion 66, and the cleaning liquid CL which is accumulated in the corner portion 66 is kept by the wiper 711. Further, the wiping is performed while the cleaning liquid which is kept by the wiper 711 is spread on the nozzle forming surface 60.

Figure 5E:
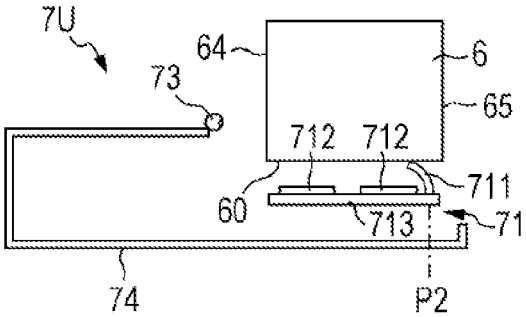

FIG. 5E illustrates a state in which the wiper 711 is moved to the end point P2. The end point P2 of the reciprocating operation performed by the wiper 711 is located on the lower side of the print head 6. A reason for setting the location of the end point P2 to the lower side of the print head 6 as described above is as follows. If the wiper 711 is moved to the right side rather than to the side surface 65 which is on the opposite side of the liquid supplied surface 64, the wiping surface 711*b* of the wiper 711 (FIG. 2) abuts on the side surface 65 when the wiper 711 is subsequently moved toward the start point P1. Since the cleaning liquid is not ejected onto the side surface 65, an extraneous substance, such as cured UV ink or the like, remains. If the wiper 711 abuts on the side surface 65, there is a problem in that the extraneous substance adheres to the wiper 711. Here, when the location of the end point P2 is on the lower side of the print head 6, the wiping surface 711*b* is prevented from abutting on the side surface 65, and excellent wiping is realized.

Figure 5F:
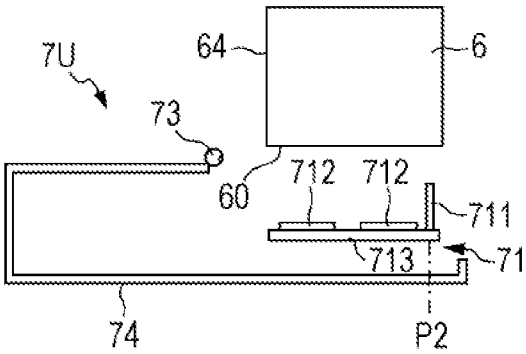
Figure 5G:
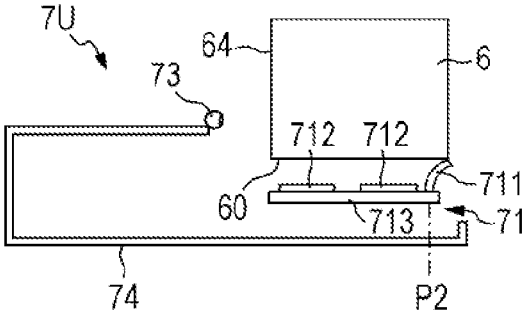

Subsequently, after the print head 6 is moved once to the retracted location, the print head 6 returns to the cleaning location in step S6. When the print head 6 is moved once to the retracted location, a state in which the wiper 711 located at the end point P2 is bent to the left side is eliminated (FIG. 5F). Further, if the wiper 711 is bent to the right side by the nozzle forming surface 60 when the print head 6 returns to the cleaning location as shown in FIG. 5G, the wiper 711 smoothly moves from the end point P2 to the start point P1. Meanwhile, for example, if the wiper 711 is managed such that the wiper 711 is slightly inclined to the right side in the state of FIG. 5F, it is possible to securely bend the wiper 711 to the right side when the print head 6 returns to the cleaning location.

Figure 5H:
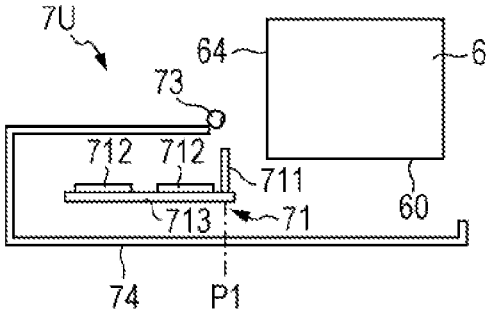

The wiping is performed by moving the wiper 711 from the end point P2 to the start point P1 in a state in which the wiper 711 is bent to the right side in step S7. In this way, if the wiper 711 returns to the start point P1, the reciprocating operation of the wiper 711 is completed one time (FIG. 5H). Subsequently, after the print head 6 is once moved to the retracted location, the print head 6 is moved to the cleaning location again in step S8. Further, after the control unit 100 increases the number of times N that the wiper 711 performs the reciprocating operation in step S9, the control unit 100 determines whether or not the reciprocating operation is performed by five times in step S10. The process returns to step S5 and repeats the reciprocating operation if the number of times of the reciprocating operation is less than 5 times, and the pressure cleaning is performed subsequently if the number of times of the reciprocating operation reaches five times in step S11. If the pressure cleaning is completed, the print head 6 is finally moved to the retracted location in step S12, the wiper 711 is moved to the stand-by location in step S13, and the process returns to the state of FIG. 5A.

Figure 6:
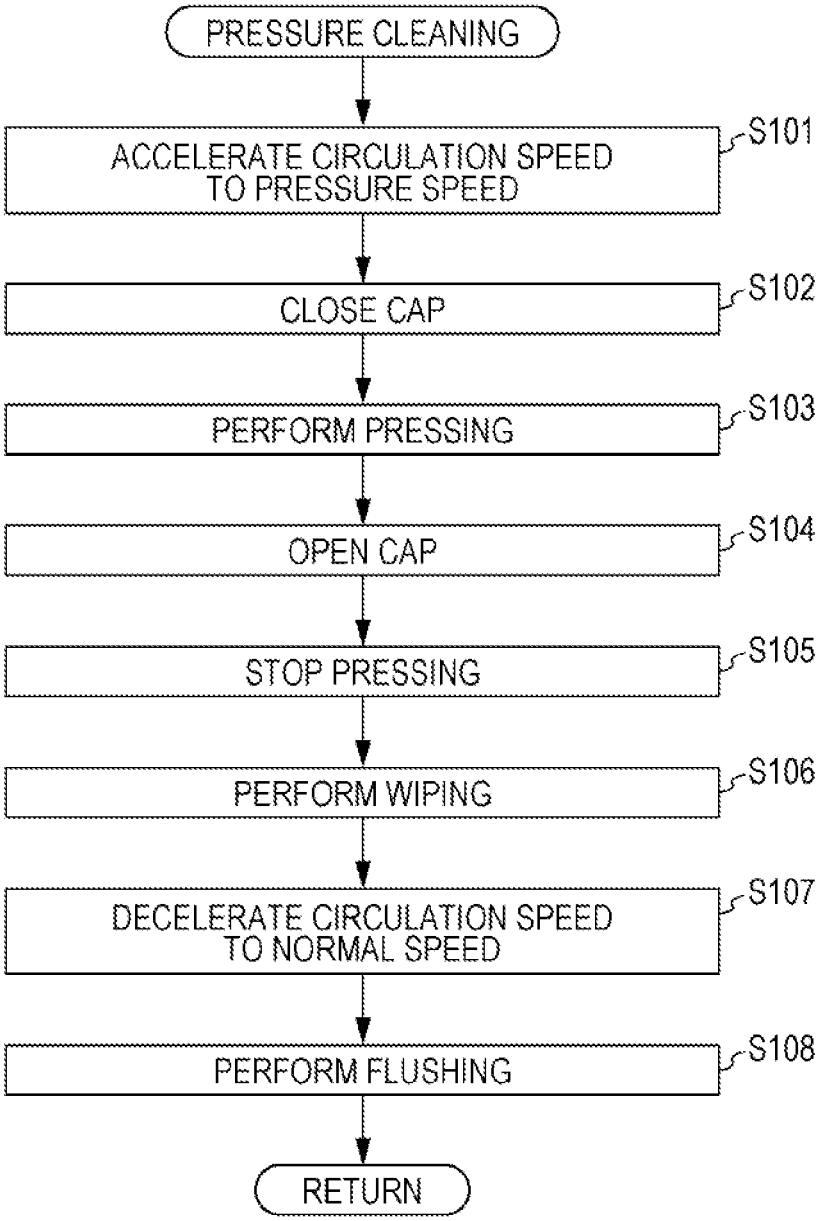
FIG. 6 is a flowchart illustrating flow of pressure cleaning.
Figure 7A:
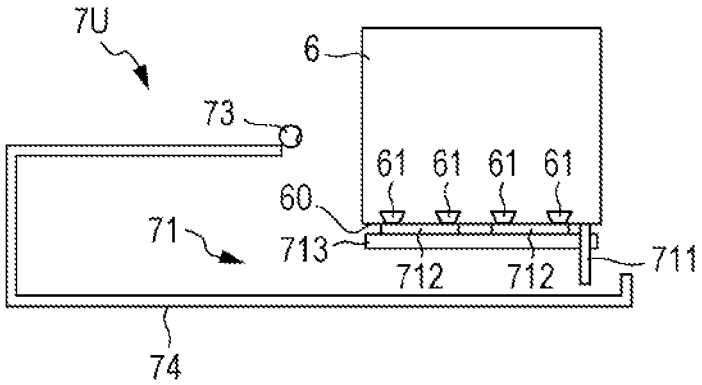
FIGS. 7A and 7B are schematic views illustrating the states of the print head and the maintenance unit.
Figure 7B:
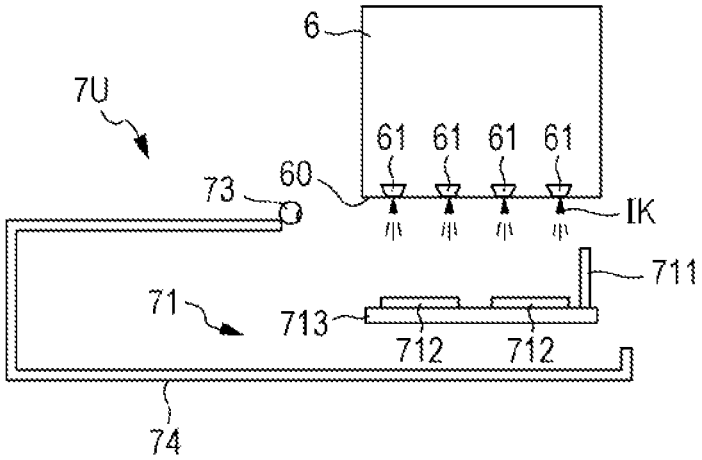

Subsequently, the pressure cleaning will be described. FIG. 6 is a flowchart illustrating the flow of the pressure cleaning, and FIGS. 7A and 7B are schematic views illustrating states of the print head and the maintenance unit. In the pressure cleaning, the ink circulation mechanism 80 (FIG. 2) first accelerates the circulation speed of ink up to a pressure speed which is higher than a normal speed when a print operation is performed in response to an operation signal from the control unit 100 in step S101.

Subsequently, as shown in FIG. 7A, after the moving body 71 of the maintenance unit 7U is moved to the lower side of the print head 6, the print head 6 is moved to a capping location which is further on the lower side than the cleaning location, and thus the nozzle forming surface 60 is pressed by the caps 712 and all of the nozzles 61 are capped in step S102. Meanwhile, the wiper 711 normally maintains a state in which the wiper 711 protrudes toward the upper side from the support member 713 by an energization member which is not shown in the drawing. However, when the print head 6 is moved to the capping location, the print head 6 resists the energization member, thereby moving the wiper 711 to the lower side. Therefore, the wiper 711 does not disturb capping.

If the capping is completed, the ink is pressed by the ink circulation mechanism 80 in step S103. If the ink is sufficiently pressed, the capping is released by moving the print head 6 to the retracted location in step S104. When the capping is released, pressed ink IK is discharged from the nozzles 61 as shown in FIG. 7B. At this time, the cleaning liquid, bubbles, and the like in the nozzles 61 are released from the nozzles 61 together with the ink IK which is discharged from the nozzles 61. As described above, if the capping is released and the ink is discharged from the nozzles 61, pressing of the ink stops in step S105.

In the pressure cleaning, the wiping is further performed on the nozzle forming surface 60 in step S106. Here, it is possible to use various forms of wiping. For example, the wiper 711 may be moved from the start point P1 to the end point P2 only one time without supplying the cleaning liquid. Accordingly, the ink, which is discharged from the nozzles 61 and adheres to the nozzle forming surface 60, is wiped away. Subsequently, after the circulation speed of the ink is reduced to a normal speed in step S107, flushing in which the ink is discharged from all of the nozzles 61 is performed, and thus the nozzles 61 are filled with the ink in a state in which suitable meniscus are formed in step S108. If the above-described pressure cleaning ends, the process returns to the flowchart of FIG. 4, steps S12 and S13 are performed, and the maintenance ends.

Figure 8A:
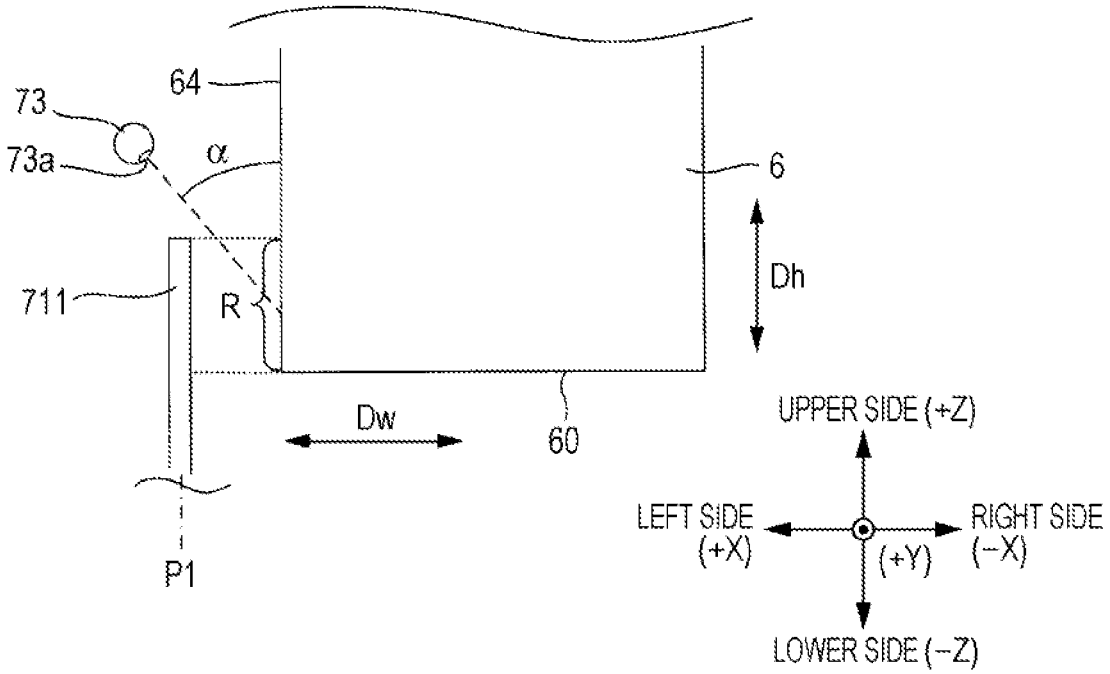
FIGS. 8A and 8B are schematic views illustrating the suitable ejecting states of cleaning liquid.
Figure 8B:
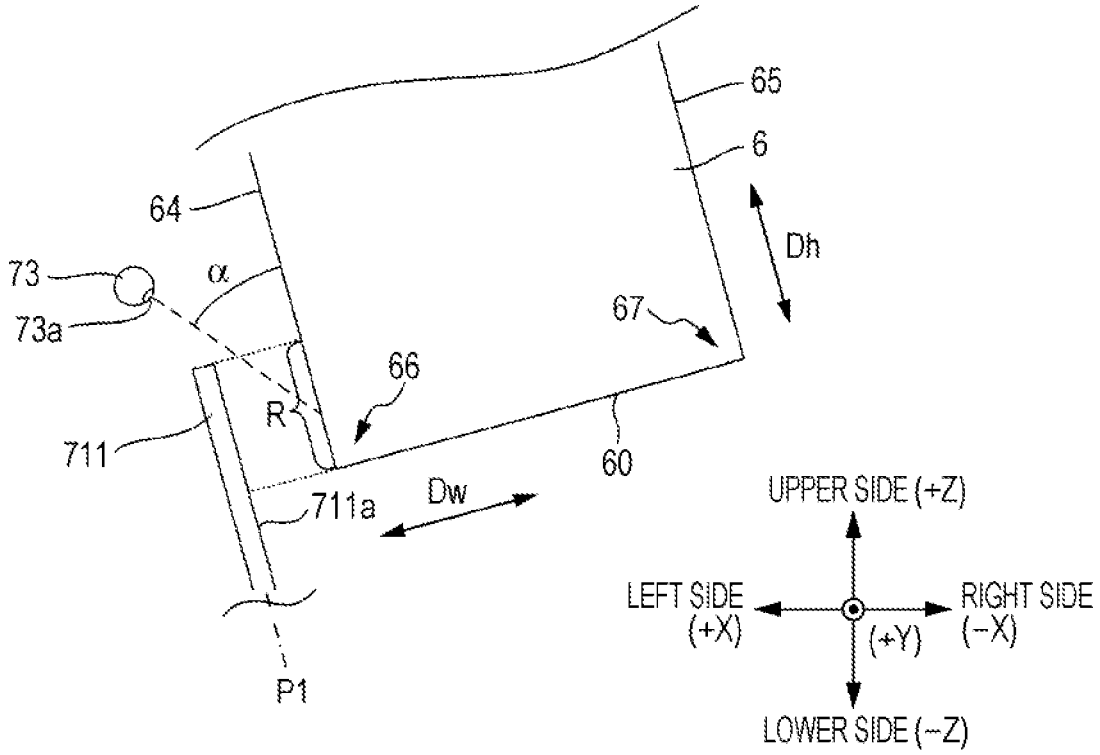

Subsequently, a suitable supply form of the cleaning liquid will be described. FIGS. 8A and 8B are schematic views illustrating suitable ejecting states of the cleaning liquid. More specifically, FIG. 8A illustrates a case in which the nozzle forming surface 60 is approximately horizontal, and FIG. 8B illustrates a case in which the nozzle forming surface 60 is inclined from a horizontal plane. Meanwhile, as shown in FIG. 8B, even when the nozzle forming surface 60 is inclined from the horizontal plane, it is apparent that it is possible to perform maintenance which has been described so far by providing the maintenance unit 7U such that the wiping direction Dw is provided along the nozzle forming surface 60.

Each of the diagrams of FIGS. 8A and 8B illustrates the state in which the cleaning liquid is ejected from the ejecting holes 73*a* of the cleaning liquid supply pipe 73 when the print head 6 is located in the cleaning location and the wiper 711 is located in the start point P1 of the reciprocating operation, and each corresponds to the diagram of FIG. 5C. At this time, as described above, a state in which the tip portion of the wiping surface 711*a* of the wiper 711 faces the liquid supplied surface 64 of the print head 6, in other words, a state in which the wiper 711 partially overlaps with the liquid supplied surface 64 in the receding direction Dh is made, and a facing region R is formed on the liquid supplied surface 64.

Further, the arrangement of the cleaning liquid supply pipe 73, the opening direction of the ejecting holes 73*a*, and the like are adjusted such that the cleaning liquid which is ejected from the ejecting holes 73*a* lands on the facing region R. Even if the cleaning liquid lands on the facing region R and the cleaning liquid which is ejected toward the liquid supplied surface 64 removes and dusts off the extraneous substance which adheres to the liquid supplied surface 64 at the time of lading, most of the dusted-off extraneous substance does not adhere to the tip portion of the wiping surface 711*a* of the wiper 711. Therefore, it is possible to prevent the dusted-off extraneous substance from adhering to the tip portion of the wiping surface 711*a* of the wiper 711 and from damaging the nozzle forming surface 60.

In addition, it is preferable to eject the cleaning liquid such that a landing angle $\alpha$ formed of the landing direction (dotted lines in FIGS. 8A and 8B), acquired when the cleaning liquid lands on the liquid supplied surface 64, and the liquid supplied surface 64 is equal to or less than 45 degrees. In this way, it is possible to prevent the cleaning liquid from rebounding from the liquid supplied surface 64 when the cleaning liquid lands, and it is possible to effectively use the cleaning liquid which is supplied to the liquid supplied surface 64 for the wiping. In addition, although there is a case in which the cleaning liquid which is ejected toward the liquid supplied surface removes and dusts off the extraneous substance which adheres to the liquid supplied surface when the cleaning liquid lands, it is possible to prevent the dusted-off extraneous substance from adhering to the wiping surface of the wiping member by setting the landing angle to be equal to or less than 45 degrees. Therefore, it is possible to preferably prevent the dusted-off extraneous substance from damaging the nozzle forming surface.

Here, when the nozzle forming surface 60 is inclined from the horizontal plane as shown in FIG. 8B, it is preferable to set the side surface 64 that forms the corner portion, which faces the lower side, with the nozzle forming surface 60 as the liquid supplied surface from among two side surfaces 64 and 65 which are connected to the nozzle forming surface 60 in the wiping direction Dw. That is, the side surface 64 that forms the corner portion 66, which faces the lower side, with the nozzle forming surface 60 may be set to the liquid supplied surface.

If the cleaning liquid is supplied to the side surface 65 which is opposite to the side surface 64, the cleaning liquid flows to the lower side along the side surface 65, reaches the corner portion 67, and further flows to the lower side along the nozzle forming surface 60, and thus it is difficult for the cleaning liquid to accumulate in the corner portion 67. In contrast, if the corner portion 66 which is formed with the nozzle forming surface 60 supplies the cleaning liquid toward the side surface 64 which faces the lower side, the cleaning liquid, which flows to the lower side along the side surface 64 and reaches the corner portion 66, does not have an escape, and thus the cleaning liquid is more securely accumulated in the corner portion 66. Therefore, it is possible to utilize more cleaning liquid for the wiping by causing the wiping surface 711*a* of the wiper 711 to abut on the corner portion 66 and then performing the wiping. Meanwhile, a state in which the corner portion 66 faces the lower side indicates a state in which both surfaces 60 and 64 which form the corner portion 66 extending further toward the upper side than toward the horizontal plane from the corner portion 66.

Figure 9A:
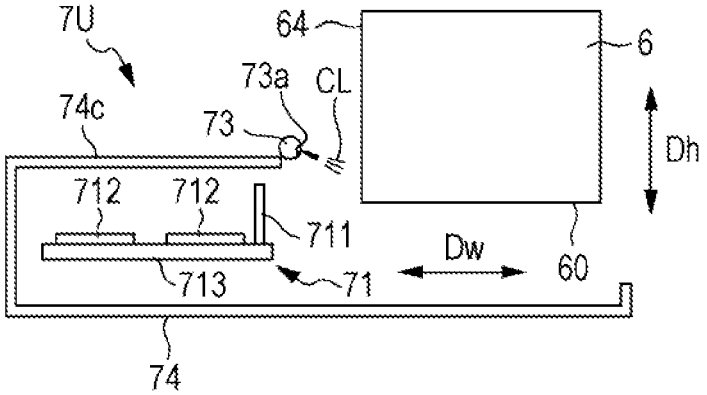
FIGS. 9A and 9B are schematic views illustrating a side surface cleaning mode and a wiper cleaning mode.
Figure 9B:
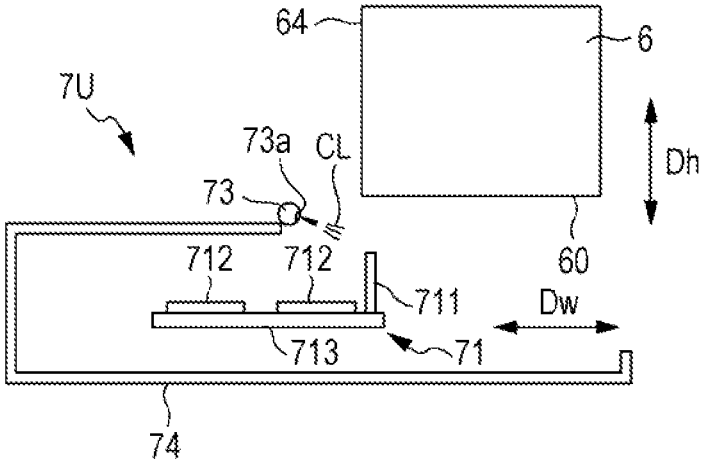

However, in the printer 1 according to the embodiment, it is possible to perform a side surface cleaning mode in which the side surface 64 (liquid supplied surface) of the print head 6 is cleaned by the cleaning liquid or a wiper cleaning mode in which the wiper 711 is cleaned by the cleaning liquid at an appropriate timing using the maintenance unit 7U. FIGS. 9A and 9B are schematic views illustrating the side surface cleaning mode and the wiper cleaning mode. More specifically, FIG. 9A illustrates the side surface cleaning mode and FIG. 9B illustrates the wiper cleaning mode.

As shown in FIG. 9A, in the side surface cleaning mode, the head driving mechanism 69 moves the print head 6 in the receding direction Dh to arrange the print head 6 in the cleaning location which is close to the maintenance unit 7U and the wiper driving mechanism 72 moves the moving body 71 in the wiping direction Dw to arrange the moving body 71 in the stand-by location on the lower side of the eave portion 74*c* according to the operational instruction from the control unit 100. If the cleaning liquid CL is ejected from the cleaning liquid supply pipe 73 in this state, the cleaning liquid CL lands on the liquid supplied surface 64 and the liquid supplied surface 64 is cleaned by the cleaning liquid CL.

Meanwhile, the locations of the print head 6 and the moving body 71 in the side surface cleaning mode are not limited to those in the above description. For example, the print head 6 may be arranged in a location further on the lower side (for example, the capping location shown in FIG. 7A) than the cleaning location, and the print head 6 may be moved in the receding direction Dh while cleaning. In addition, the side surface cleaning mode may be performed in a state in which the moving body 71 is located in a location other than the stand-by location, for example, a state of FIG. 5C in which the wiper 711 is located at the start point P1.

In contrast, as shown in FIG. 9B, in the wiper cleaning mode, the head driving mechanism 69 moves the print head 6 in the receding direction Dh to arrange the print head 6 in the retracted location which is separated from the maintenance unit 7U, and the wiper driving mechanism 72 moves the wiper 711 in the wiping direction Dw to arrange the wiper 711 in a location in which the cleaning liquid CL reaches the wiper 711 according to the operational instruction from the control unit 100. If the cleaning liquid CL is ejected from the cleaning liquid supply pipe 73 in this state, the cleaning liquid CL lands on the wiper 711, and the wiper 711 is cleaned by the cleaning liquid CL.

Meanwhile, in the wiper cleaning mode, it is possible to clean the caps 712 at the same time. That is, it is possible to clean the caps 712 by moving the moving body 71 to the right side from the location shown in FIG. 9B while maintaining a state in which the cleaning liquid CL is ejected from the cleaning liquid supply pipe 73. In addition, the location of the print head 6 in the wiper cleaning mode is not limited to the retracted location, and another location may be used if the cleaning liquid CL does not reach the location.

As described above, when the side surface cleaning mode and the wiper cleaning mode are provided, it is possible to appropriately clean the side surface 64 of the print head 6 or the wiper 711 and to perform appropriate wiping. In addition, since each mode is realized by the head driving mechanism 69 and the wiper driving mechanism 72 which are used when the wiping is performed, it is not necessary to provide an additional driving mechanism, thereby being suitable. Further, in the wiper cleaning mode, the liquid supplied surface 64 is moved to a location which the cleaning liquid from the cleaning liquid supply pipe 73 does not reach, and the wiper 711 is moved to a location which the cleaning liquid from the cleaning liquid supply pipe 73 reaches. In this way, it is possible to switch from a state in which the cleaning liquid can be supplied to the liquid supplied surface 64 to a state in which the cleaning liquid can be supplied to the wiper 711 without moving the cleaning liquid supply pipe 73, and thus it is possible to easily configure the cleaning liquid supply pipe 73.

As described above, in the embodiment, the wiping is performed after the cleaning liquid is supplied to the liquid supplied surface 64, with which the wiping surface 711*a* of the wiper 711 can come into contact and the wiping surface 711*a* abuts on the liquid supplied surface 64. When the wiping surface 711*a* abuts on the liquid supplied surface 64, the cleaning liquid which is supplied to the liquid supplied surface 64 is moved to the wiping surface 711*a*, and the wiping is performed in a state in which the wiping surface 711*a* holds the cleaning liquid. Therefore, it is possible to effectively clean the nozzle forming surface 60. Besides, the cleaning liquid is not directly supplied to the nozzle forming surface 60 and is supplied to the liquid supplied surface 64 which is different from the nozzle forming surface 60, and thus it is possible to effectively prevent the cleaning liquid from coming in the nozzles 61 when the cleaning liquid is supplied.

In addition, in the embodiment, the liquid supplied surface 64 has a height in the vertical direction, and the wiping surface 711*a* of the wiper 711 is relatively moved on the nozzle forming surface 60 in a state in which the wiping surface 711*a* of the wiper 711 abuts on the lower end portion of the liquid supplied surface 64, to which the cleaning liquid is supplied, and then abuts on the nozzle forming surface 60. As above, if the cleaning liquid is supplied to the liquid supplied surface 64 which has a height in the vertical direction, the cleaning liquid flows into the lower side along the liquid supplied surface 64, and thus it is easy for the cleaning liquid to be accumulated at the lower end portion of the liquid supplied surface 64. Therefore, when the wiping surface 711*a* abuts on the lower end portion of the liquid supplied surface 64, it is possible to hold a large amount of cleaning liquid on the wiping surface 711*a*, and thus it is possible to effectively use the cleaning liquid.

Further, in the embodiment, when the lower end portion of the liquid supplied surface 64 is connected to a connected surface (nozzle forming surface 60) which is different from the liquid supplied surface 64, the corner portion 66 is formed between the liquid supplied surface 64 and the connected surface 60, and the corner portion 66 faces the lower side. As above, when the lower end portion of the liquid supplied surface 64 is connected to the connected surface 60 and the corner portion 66 is formed between the liquid supplied surface 64 and the connected surface 60, the cleaning liquid which is supplied to the liquid supplied surface 64 flows to the lower side along the liquid supplied surface 60 and reaches the corner portion 66 which includes the lower end portion of the liquid supplied surface 64. Further, because the corner portion 66 faces the lower side, the cleaning liquid which reaches the corner portion 66 does not have an escape, and thus the cleaning liquid is more securely accumulated in the corner portion 66. As a result, it is possible to utilize a larger amount of cleaning liquid to clean the nozzle forming surface 60.

Further, in the embodiment, the liquid supplied surface is the side surface 64 of the print head 6, and the connected surface is the nozzle forming surface 60. When a function as the liquid supplied surface is provided to the side surface 64 of the print head 6 and the connected surface is set to the nozzle forming surface 60, it is not necessary to provide an additional member which includes the liquid supplied surface and the connected surface, and thus it is possible to reduce the number of components.

In addition, in the embodiment, the eave portion 74*c* which can shield against light irradiated from the UV lamps 37*a*, 37*b*, and 38 is provided. When the UV lamps 37*a*, 37*b*, and 38 are operated, that is, when the print is operated, the wiper 711 is maintained in a location in which light from the UV lamps 37*a*, 37*b*, and 38 can be shielded by the eave portion 74*c*. In this way, it is possible to prevent the UV ink which adheres to the wiper 711 from being cured, and thus it is possible to maintain the wiper 711 in a good state.

In addition, in the embodiment, the caps 712, which can be close to the nozzle forming surface 60 and the support member 713, which supports the wiper 711 and the caps 712 to be integrally moved, are provided. When the caps 712 are provided, it is possible to cap the nozzles 61 of the print head 6. Further, when the support member 713, which supports the wiper 711 and the caps 712 to be integrally moved, is provided, it is possible to move the caps 712 together with the wiper 711. Therefore, for example, when movement occurs to a location in which the wiper 711 can be cleaned in the wiper cleaning mode or when movement occurs to a location in which the wiper 711 can be shielded against light by the eave portion 74*c*, it is possible to clean the caps 712 or arrange the caps 712 in the location in which light can be shielded together with the wiper 711 by moving the caps 712 at the same time.

As described above, in the embodiment, the printer 1 corresponds to the "liquid discharging apparatus" according to an aspect of the invention, the ink corresponds to the "liquid" according to the aspect of the invention, the print head 6 corresponds to the "discharge head" according to the aspect of the invention, the wiper 711 corresponds to the "wiping member" according to the aspect of the invention, the cleaning liquid supply pipe 73 corresponds to the "cleaning liquid supply unit" according to the aspect of the invention, the wiper cleaning mode corresponds to the "cleaning mode" according to the aspect of the invention, the caps 712 corresponds to the "capping member" according to the aspect of the invention, the UV lamps 37*a*, 37*b*, and 38 correspond to the "light irradiation devices" according to the aspect of the invention, and the eave portion 74*c* corresponds to the "light shielding unit" according to the aspect of the invention.

Meanwhile, the invention is not limited to the above embodiment, and it is possible to appropriately combine the components of the embodiment and to apply various modifications without departing from the gist of the invention. For example, in the embodiment, the side surface 64 of the print head 6 is used as the liquid supplied surface, and the cleaning liquid is supplied by ejecting the cleansing liquid toward the side surface 64. However, the cleaning liquid may be supplied to a member which is separated from the print head 6.

In addition, in the embodiment, the wiping is performed by moving the wiper 711 in the wiping direction Dw. However, the wiping may be performed by moving the nozzle forming surface 60, that is, the print head 6, in the wiping direction Dw. In addition, it is possible to perform the wiping by moving both the wiper 711 and the print head 6 in the wiping direction Dw.

In addition, in the embodiment, it is possible to appropriately modify the flows shown in FIGS. 4 and 6. For example, the wiper 711 may be operated only in the direction which faces the end point P2 from the start point P1 without causing the wiper 711 to perform the reciprocating operation in the wiping direction Dw. In addition, it is possible to appropriately modify the number of times that the wiper 711 is moved in the wiping direction Dw when the wiping is performed.

In addition, it is possible to appropriately modify the detailed configuration of the printer 1, the arrangement or the number of the print heads 6 and the maintenance units 7U may be appropriately modified, or the shape or the like of the platen drum 30 may be appropriately modified.

In addition, the kind of the ink which is discharged from the nozzles 61 is not limited to the above-described UV ink. Further, it is possible to apply the invention to a liquid discharging apparatus which discharges liquid other than the ink.

The entire disclosure of Japanese Patent Application No. 2013-042671, filed Mar. 5, 2013 is expressly incorporated by reference herein.

What is claimed is:

1. A liquid discharging apparatus comprising:

a discharge head that includes a nozzle forming surface on which nozzles for discharging liquid are formed;

a wiping member that performs wiping by relatively moving on the nozzle forming surface in a state in which a wiping surface abuts on the nozzle forming surface;

a cleaning liquid supply unit that supplies cleaning liquid to a liquid supplied surface which is a different surface of the discharge head from the nozzle forming surface and with which the wiping surface can come into contact; and a control unit that causes the wiping surface to abut on the liquid supplied surface to which the cleaning liquid is supplied, and then causes the wiping surface to relatively move on the nozzle forming surface in a state in which the wiping surface abuts on the nozzle forming surface.

2. The liquid discharging apparatus according to claim 1, wherein the liquid supplied surface has a height in a vertical direction, and wherein the control unit causes the wiping surface to abut on a lower end portion of the liquid supplied surface to which the cleaning liquid is supplied, and then causes the wiping surface to relatively move on the nozzle forming surface in the state in which the wiping surface abuts on the nozzle forming surface.

3. The liquid discharging apparatus according to claim 2, wherein, when the lower end portion of the liquid supplied surface is connected to a connected surface which is different from the liquid supplied surface, a corner portion is formed between the liquid supplied surface and the connected surface, and the corner portion faces the lower side in the vertical direction.

4. The liquid discharging apparatus according to claim 3, wherein the liquid supplied surface is a side surface of the discharge head, and the connected surface is the nozzle forming surface.

5. The liquid discharging apparatus according to claim 1, wherein, when the cleaning liquid is supplied, the wiping surface of the wiping member faces the liquid supplied surface, and wherein the cleaning liquid supply unit ejects the cleaning liquid such that the cleaning liquid lands on a facing region of the liquid supplied surface, which the wiping surface faces.

6. The liquid discharging apparatus according to claim 1, wherein the cleaning liquid supply unit ejects the cleaning liquid such that a landing angle which is formed of a landing direction, acquired when the cleaning liquid lands on the liquid supplied surface, and the liquid supplied surface is equal to or less than 45 degrees.

7. The liquid discharging apparatus according to claim 1, wherein the control unit can perform a cleaning mode in which the wiping member is cleaned in such a way that the cleaning liquid supply unit supplies the cleaning liquid to the wiping member.

8. The liquid discharging apparatus according to claim 7, wherein, in the cleaning mode, the control unit moves the liquid supplied surface to a location which the cleaning liquid from the cleaning liquid supply unit does not reach, and moves the wiping member to a location which the cleaning liquid from the cleaning liquid supply unit reaches.

9. The liquid discharging apparatus according to claim 1, wherein the liquid is photocurable ink that is cured when light is irradiated, wherein the liquid discharging apparatus further includes a light irradiation device that irradiates light, and a light shielding unit that can shield against light irradiated from the light irradiation device, and wherein, when the light irradiation device is operated, the control unit maintains the wiping member in a location in which light from the light irradiation device can be shielded by the light shielding unit.

10. The liquid discharging apparatus according to claim 1, further comprising:

a capping member that can seal the nozzles; and a support member that supports the wiping member and the capping member to be integrally moved.

11. A method of cleaning a discharge head that includes a nozzle forming surface on which nozzles for discharging liquids are formed, comprising:

supplying cleaning liquid to a liquid supplied surface which is a different surface of the discharge head from the nozzle forming surface and which can abut on a wiping surface of a wiping member; and performing wiping by causing the wiping surface to abut on the liquid supplied surface to which the cleaning liquid is supplied, and then causing the wiping surface to relatively move on the nozzle forming surface in a state in which the wiping surface abuts on the nozzle forming surface.

12. A liquid discharging apparatus comprising:

a discharge head that includes a nozzle forming surface on which nozzles for discharging liquid are formed;

a wiping member that performs wiping by relatively moving on the nozzle forming surface in a state in which a wiping surface abuts on the nozzle forming surface;

a cleaning liquid supply unit that supplies cleaning liquid to a liquid supplied surface which is a different surface from the nozzle forming surface and with which the wiping surface can come into contact; and a control unit that causes the wiping surface to abut on the liquid supplied surface to which the cleaning liquid is supplied, and then causes the wiping surface to relatively move on the nozzle forming surface in a state in which the wiping surface abuts on the nozzle forming surface, wherein the cleaning liquid supply unit ejects the cleaning liquid such that a landing angle which is formed of a landing direction, acquired when the cleaning liquid lands on the liquid supplied surface, and the liquid supplied surface is equal to or less than 45 degrees.

* * * * *